US007750246B2

(12) United States Patent
Ferlier et al.

(10) Patent No.: US 7,750,246 B2
(45) Date of Patent: Jul. 6, 2010

(54) ELECTRIC CABLE THAT WITHSTANDS ELECTRIC ARC PROPAGATION

(75) Inventors: Jean-Pierre Ferlier, Yerres (FR); Pascal Clouet, Vigneux sur Seine (FR); Rui Manuel Da Silva, Chilly-Mazarin (FR)

(73) Assignee: Nexans, Paris (FR)

( * ) Notice: Subject to any disclaimer, the term of this patent is extended or adjusted under 35 U.S.C. 154(b) by 147 days.

(21) Appl. No.: 12/221,190

(22) Filed: Jul. 31, 2008

(65) Prior Publication Data

US 2009/0090552 A1 Apr. 9, 2009

(30) Foreign Application Priority Data

Sep. 21, 2007 (FR) ..... 07 57741

(51) Int. Cl.
*H01B 7/00* (2006.01)

(52) U.S. Cl. ..... 174/120 R

(58) Field of Classification Search ..... 174/120 R, 174/120 SR

See application file for complete search history.

(56) References Cited

U.S. PATENT DOCUMENTS 4,034,153 A * 7/1977 Andres et al. ..... 174/120 SR

FOREIGN PATENT DOCUMENTS

| | | |
|---|---|---|
| EP | 1211696 | 6/2002 |
| FR | 2573910 | 5/1986 |
| FR | 2777382 | 10/1999 |
| JP | 62154505 | 7/1994 |
| WO | 0074075 | 12/2000 |

OTHER PUBLICATIONS

French International Search Report dated Mar. 20, 2008.

* cited by examiner

*Primary Examiner*—Chau N Nguyen
(74) *Attorney, Agent, or Firm*—Sofer & Haroun, LLP

(57) ABSTRACT

An electric cable includes an electrical conductor surrounded by a first layer of mica tape made up of mica particles deposited by means of a polymer binder on a backing, a second layer of a polyimide tape, and a third layer of a polytetrafluoroethylene tape, where the first layer is subjected to heat treatment at a temperature of at least 400° C. and the ratio R of the weight per unit length of PTFE over the sum of the weights per unit length of the polymer binder and of the polyimide is such that R is greater than or equal to 2 when the section of the electrical conductor is no greater than 0.2 $mm^2$, R is greater than or equal to 4 when the section of the electrical conductor is strictly greater than 0.2 $mm^2$ and strictly less than 0.6 $mm^2$, R is greater than or equal to 6 when the section of the electrical conductor is equal to 0.6 $mm^2$, and R is greater than or equal to 12 when the section of the electrical conductor is strictly greater than 0.6 $mm^2$.

17 Claims, 1 Drawing Sheet

ELECTRIC CABLE THAT WITHSTANDS ELECTRIC ARC PROPAGATION

RELATED APPLICATION

This application relates to and claims the benefit of priority to French Patent Application No. 07 57741, filed on Sep. 21, 2007, the entirety of which is incorporated by reference.

FIELD OF THE INVENTION

The present invention relates to an electric cable, and it applies typically but not exclusively to electric cables for use in aviation, e.g. on board airplanes.

BACKGROUND OF THE INVENTION

This type of electric cable needs to satisfy numerous criteria for use in aviation, in particular when placed in fire conditions.

For example, one safety criterion is to ensure that the electric cable continues to operate at high temperatures of the order of 1100° C. for some specified minimum length of time, generally of the order of 5 minutes (min) to 15 min, without its electrical conductor melting, and without propagating the fire, and that it should also withstand vibration and being sprayed with water or fire-extinguishing fluids, while continuing to ensure electrical continuity for its circuits and while conserving some minimum level of insulation resistance in flame, generally of the order of 10,000 ohms (Ω).

Other criteria can also be taken into account such as the weight and the diameter of said cable, which weight and diameter must not be excessive, the maximum temperature at which said cable can be used on a continuous basis, which maximum temperature needs to be as high as possible, generally about 260° C. for at least 20,000 hours, and the ability of said cable to be marked so as to enable it to be identified.

A more recent criterion requires a safety electric cable to operate well when associated with other electric cables to constitute a harness.

Document FR 2 573 910 describes an electric cable for aviation that comprises an electrical conductor surrounded by a first layer constituted by two windings of mica tape.

The first layer is covered in a second layer of thermostable polymer that may be constituted for example either by a polytetrafluoroethylene (PTFE) tape, or by a polyimide resin.

Finally, the second layer is covered in an intermediate layer of glass fibers, and in an outer layer of the same kind as the second layer.

Nevertheless, although that prior art electric cable satisfies the safety criteria specified above, it is not good at satisfying another safety criterion, namely that of resistance to electric arc propagation as specified by the standard NF EN 3475-604 (a method of evaluating resistance to electric arc propagation when dry) and standard EN 2346-005 (a standard defining the minimum performance required of an aviation electric cable in terms of resistance to fire and to electric arc propagation).

This safety criterion makes it possible to guarantee that the insulation of said cable presents sufficient resistance to avoid triggering and propagating electric arcs between electric cables and/or between electric cables and a conductive structure.

The technical problem to be solved by the subject matter of the present invention is to propose an electric cable that makes it possible to avoid the problems of the prior art, in particular by providing resistance to electric arc propagation that satisfies the requirements of standard EN 2346-005 concerning arc propagation testing and standard NF EN 3475-604, while maintaining the good properties of withstanding fire and operating in flame as specified in the standards NF EN 3475-408 and prEN 3475-417.

According to the present invention, the solution to the technical problem posed lies in that the electric cable comprises:

- an electrical conductor surrounded by a first layer comprising at least one winding of mica tape, said mica tape being made up of mica particles deposited by means of a polymer binder on a backing;
- a second layer comprising at least one winding of a polyimide tape; and
- a third layer comprising at least one winding of a polytetrafluoroethylene (PTFE) tape;

the first layer being subjected to heat treatment at a temperature of at least 400° C.; and the ratio R of the weight per unit length of PTFE over the sum of the weights per unit length of the polymer binder and of the polyimide being such that:

- R is greater than or equal to 2 when the section of the electrical conductor is no greater than 0.2 square millimeters ($mm^2$), and preferably lies in the range 0.1 $mm^2$ to 0.2 $mm^2$;
- R is greater than or equal to 4 when the section of the electrical conductor is strictly greater than 0.2 $mm^2$ and strictly less than 0.6 $mm^2$;
- R is greater than or equal to 6 when the section of the electrical conductor is equal to 0.6 $mm^2$; and
- R is greater than or equal to 12 when the section of the electrical conductor is strictly greater than 0.6 $mm^2$, and preferably no more than 3 $mm^2$.

The Applicant has discovered, surprisingly, that for a given range of electrical conductor sections, imparting specific heat treatment to the first layer in combination with a ratio R of weight per unit length of PTFE over the sum of the weights per unit length of the polymer binder plus the polyimide makes it possible to achieve dry electric arc propagation resistance of more than 75%, as specified by the standards NF EN 3475-604 and EN 2346-005.

In addition, the electric cable most advantageously retains very good resistance to fire and ensures electrical circuit continuity well, while presenting weight and diameter that are relatively small, so as to satisfy the criteria required in aviation.

OBJECTS AND SUMMARY OF THE INVENTION

In a preferred embodiment, the first layer is subjected to heat treatment for a duration $\underline{t}$ that is at least 30% longer than the duration $t_0$ needed for degassing the first layer, said duration $\underline{t}$ preferably being at least 1 minute.

According to a preferred characteristic, the mica tape includes at most 20% by weight of polymer binder, the mica tape preferably including 13% by weight of polymer binder.

By way of preferred example, said polymer binder is a silicone resin.

According to another preferred characteristic, the percentage overlap of a mica tape onto itself during winding and/or of a polyimide tape onto itself during winding is no greater than 49%.

This percentage advantageously makes it possible to guarantee an optimized ratio R, thereby improving resistance to electric arc propagation by being combined with the appropriate minimum quantity of PTFE.

According to another preferred characteristic, the second layer comprises a single winding of polyimide tape.

According to another preferred characteristic, the third layer comprises at least two windings of PTFE tape.

These preferred characteristics serve advantageously to minimize the quantity of polymer binder and of polyimide, and consequently to increase the ratio R so as to improve the resistance of the electric cable to electric arc propagation, while preserving its final weight and diameter and its fire-resistance properties.

In a particularly advantageous embodiment, the mica particles are of the phlogopite type.

By means of particles of this type, better insulation resistance is obtained in flame.

In another embodiment, the polyimide tape comprises a layer of polyimide covered on each of its face in a coating of fluorinated ethylene propylene copolymer (FEP).

The FEP coatings serve in particular to obtain bonding between the respective overlaps and/or windings of the polyimide tape(s), and bonding between the second layer and the third layer.

In this embodiment, the second layer is subjected to heat treatment at a temperature higher than the melting temperature of the layers of FEP.

The third layer may also be subjected to heat treatment at a temperature higher than 340° C., thus enabling the PTFE to be sintered and providing bonding between the respective overlaps and/or windings of the PTFE tape(s).

Advantageously, the heat treatment of the second layer may be performed simultaneously with the heat treatment of the third layer.

In another embodiment, the electric cable further includes a (surface) outer layer that is suitable for being marked.

By way of particularly advantageous embodiment, the third layer further includes said outer layer, which outer layer is preferably a PTFE tape including titanium oxide white pigment.

The present invention also provides an electric harness including at least one electric cable as defined above.

Preferably, the harness combines a plurality of electric cables of the present invention, said electric cables forming an assembly that is covered in a protective sheath of the mechanical protection type that is well known to the person skilled in the art.

By way of example, the protective sheath comprises one or more metal braids made of copper or steel.

Said protective sheath may also be covered by a braid of textile material that withstands abrasion and that does not propagate fire, e.g. of the aromatic polyamide type.

BRIEF DESCRIPTION OF THE DRAWING

Other characteristics and advantages of the present invention appear in the light of the following examples given with reference to the sole annotated FIGURE, which examples and FIGURE are given by way of non-limiting illustration.

MORE DETAILED DESCRIPTION

Figure 1:
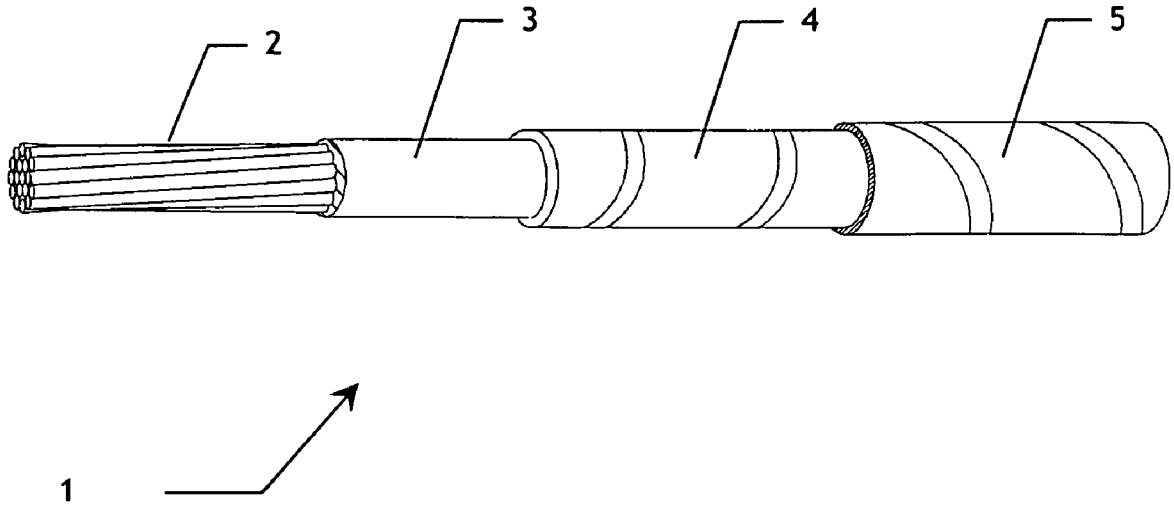
FIG. 1 is a diagrammatic perspective view showing the structure of an electric cable 1 in accordance with the present invention.

The electric cable 1 comprises an electrical conductor 2, e.g. of copper or of copper alloy covered in a layer of nickel, of weight comprising at least 27% nickel, and generally of the multistrand type.

Said electrical conductor 2 is surrounded by a first layer 3, said first layer 3 comprising at least one winding of a mica tape, preferably a single winding of mica tape.

The mica tape is typically made up of particles (or flakes) of mica held by means of a polymer binder to a backing of the tape comprising glass fibers that are generally woven, but that need not be woven.

The mica may be of the muscovite or of the phlogopite type, and by way of example, the polymer binder may be of the silicone resin type, of the polyimide type, of the polyamide-imide type, or of any other thermostable polymer type.

Thereafter, the first layer 3 is surrounded by a second layer 4, said second layer 4 comprising at least one winding of a polyimide tape, preferably a single winding of polyimide tape.

Finally, the second layer 4 is surrounded by a third layer 5, said third layer 5 comprising at least one winding of a PTFE tape, the PTFE tape preferably being free from any pigments.

The surface or outer layer of the third layer 5 may advantageously comprise a layer of pigmented PTFE, where the pigment is constituted by titanium dioxide, for example, so as to enable the surface of the outer layer to be marked by means of a UV laser.

Typically, the successive tapes are wound in opposite directions so as to avoid tape coming off during fabrication of said cable.

Preferably, the overlap percentage of each mica tape onto itself and of each polyimide tape onto itself is no more than 49% (overlap coefficient Kr no more than 0.49).

Advantageously, this overlap percentage makes it possible to guarantee an optimized ratio R of weight per unit length of PTFE over the sum of the weight per unit length of polymer binder and of polyimide that is adapted to the section of the electrical conductor (electrical core), or in other words to limit the weights per unit length of the first and second layers, thus making it possible to improve the ability of the electric cable to withstand electric arc propagation.

During fabrication of the electric cable of the present invention, the laying of the second and third layers may include a heat treatment step.

After the first layer has been laid (taped), the electrical conductor as insulated in this way is subjected to heat treatment in an oven at a temperature of not less than 400° C. This is the step of thermally degrading the mica tape, and in particular its polymer binder.

By way of example, this heat treatment is performed for a duration $\underline{t}$ that is at least 30% greater than the duration $t_0$ that is required for degassing said tape.

The time $t_0$ needed for degassing is generally determined experimentally, and degassing is typically performed at a temperature of about 340° C.

More particularly, $t_0$ is determined from the moment when the layers placed over the layer for degassing no longer "blister" under the effect of the gas being given off during heat treatment ("baking") of the outer layers at a temperature of not less than 340° C.

Thus, degassing serves to limit residual volatile compounds in the first layer, which compounds can lead to insulation defects during subsequent steps of heat treatment, such as for example applying heat treatment to the second and third layers.

Furthermore, in particularly advantageous manner, this heat treatment also makes it possible to facilitate obtaining an electric cable with resistance to the arc propagation that is sufficient (greater than 75%) when its temperature is at least 400° C.

By way of non-limiting example, an electrical conductor having a section of 0.6 $mm^2$, insulated with a first layer comprising a single winding of mica tape is passed through an oven that is 8 meters (m) long, with six heating zones of identical length, the six heating zones having the following successive respective temperatures: 340° C.-400° C.-400° C.-450° C.-450° C.-450° C.

The time needed for degassing the mica tape is typically 40 seconds ($t_0$), giving a travel speed of 12 meters per minute through the oven having a length of 8 m.

By adding at least 30% $t_0$, a minimum duration $\underline{t}$ is obtained of about 1 minute, i.e. a speed through the oven of 8 m per minute.

Thus, the mica tape reaches a temperature of at least 400° C. on spending a time (t) of 1 minute in the above-described oven.

If the mica tape were to pass through said oven in 40 seconds ($t_0$), then it might reach a temperature of no more than about 340° C.

After the second layer has been laid (or taped), and when the polyimide tape comprises a layer of polyimide covered on both faces in respective layers of a fluorinated ethylene propylene copolymer (FEP), the electrical conductor as insulated in this way can be subjected to heat treatment in an oven at a temperature higher than the melting temperature of the outer layers of FEP on the polyimide tape.

Typically, this melting temperature is higher than 260° C. This is the step of heat sealing the second layer.

After the third layer has been laid (or taped), the electrical conductor as insulated in this way can be subjected to heat treatment in an oven at a temperature higher than the melting temperature of PTFE, i.e. a temperature of 342° C. in order to sinter the PTFE.

In particularly preferred manner, the steps of taping the second and third layers are performed one after the other and they are followed by a single step of applying heat treatment to the second and third layers at a temperature that is higher than 340° C., and more particularly that is equal to 342° C.

The second and third layers are thus subjected to heat treatment simultaneously.

By means of this single heat treatment step that involves both heat sealing the polyimide and sintering the PTFE, it is ensured that all of the thicknesses of tape in the second and third layers are bonded to one another (overlaps and windings) and also that the second and third layers are bonded to each other.

Finally, the electric cable may advantageously include an outer layer that enables the electric cable of the present invention to be marked, preferably by UV laser marking.

This outer layer may surround the third layer, however it may be included in the third layer and form part thereof, or in other words the outer layer is likewise a winding of PTFE tape, however this outer layer being suitable for UV laser marking.

Typically, it comprises a pigmented PTFE tape that preferably includes white titanium dioxide pigment in a quantity of no more than 5% by weight of said PTFE tape.

It is preferable to avoid exceeding this value of 5%, or indeed to use a smaller value, since the presence of titanium dioxide pigment can be harmful in terms of ability to withstand electric arc propagation.

In order to demonstrate the advantages of electric cables of the present invention, Tables 1a and 1b below list various cable structures for which the ability to withstand electric arc propagation when dry, and the ratio R of the weight of PTFE per unit length over the sum of the weights of polymer binder and of polyimide per unit length have been investigated.

From top to bottom, tables 1a and 1b show the succession of the various tapes of the first, second, and third layers making up the electric cable (or insulated electric wire).

The first, second, and third layers of the electric cables DW24A to DW14C referenced in Tables 1a and 1b were subjected to heat treatment in accordance with the above-described method of fabrication, with the exception of the first layer of electric cable DW20A.

The details of the treatment of the first layer, the overlap coefficients Kr, and the thicknesses of the various tapes are also specified in Tables 1a and 1b.

The origins of the various ingredients in Tables 1a and 1b are as follows.

The mica tape was a Cablosam 366 20-80 tape sold by the supplier Von Roll-Isola, having a thickness of about 0.1 mm.

That tape has particles of phlogopite mica and a quantity of 13% by weight of polymer binder of the silicone resin type, or in other words it comprises 17 grams per square meter ($g/m^2$) of silicone resin for a mica tape presenting a total weight of 30 $g/m^2$.

The polyimide tape (or polyimide tape with fluorinated adhesive) was a polyimide 616 tape sold by the supplier DuPont de Nemours. These polyimide tapes comprise a polyimide film having a thickness of 0.025 mm coated on each of its faces in a layer of FEP resin having a thickness lying in the range 0.0015 mm to 0.0025 mm. The quantity of polyimide is equal to 76.5% by weight of said tape.

The non-sintered and non-UV laser markable PTFE tape and the non-sintered and UV markable PTFE tape of white color are sold in particular by the supplier Plastic Omnium 3P.

TABLE 1a

| | | Electric cable | | | | |
|---|---|---|---|---|---|---|
| | | DW24A | DW20A | DW20B | DW20C | DW20D |
| Electrical conductor | | Twisted, 19 copper wire strands, each having a diameter of 0.12 mm | Twisted, 19 copper wire strands, each having a diameter of 0.20 mm | | | |
| Section of electrical conductor ($mm^2$) | | 0.25 | | | 0.6 | |
| First layer | 1 mica tape thickness 0.1 mm heat treatment at more than 400° C. | Kr = 53% | — | Kr = 37% | Kr = 37% | Kr = 37% |
| | 1 mica tape thickness 0.1 mm heat treatment at more than 400° C. | Kr = 26% | — | — | — | — |
| | 1 mica tape thickness 0.1 mm heat treatment at 340° C. | — | Kr = 37% | — | — | — |

TABLE 1a-continued

| | | Electric cable | | | | |
|---|---|---|---|---|---|---|
| | | DW24A | DW20A | DW20B | DW20C | DW20D |
| Second layer | 1 polyimide tape thickness 0.030 mm | Kr = 30% | | | | |
| Third layer | 1 PTFE tape | 1 UV PTFE tape thickness 0.064 mm Kr = 53% | 1 non-UV PTFE tape thickness 0.076 mm Kr = 53% | 1 non-UV PTFE tape thickness 0.076 mm Kr = 53% | 1 non-UV PTFE tape thickness 0.064 mm Kr = 53% | 1 non-UV PTFE tape thickness 0.076 mm K = 53% |
| | 1 PTFE tape | — | 1 UV PTFE tape thinkness 0.064 mm Kr = 53% | 1 UV PTFE tape thinkness 0.064 mm Kr = 53% | 1 non-VU PTFE tape thinkness 0.064 mm Kr = 53% | 1 non-UV PTFE tape thinkness 0.076 mm Kr = 53% |
| | 1 PTFE tape | — | — | — | 1 UV PTFE tape thickness 0.064 mm Kr = 53% | 1 UV PTFE tape thickness 0.076 mm Kr = 53% |
| Weight of electric cable (g/m) | | 4.9 | 8.9 | 8.9 | 9.9 | 10.8 |
| Diameter of electric cable (mm) | | 1.59 to 1.68 | 1.80 to 1.84 | 1.80 to 1.84 | 2.00 to 2.05 | 2.12-2.17 |

TABLE 1b

| | | Electric cable | | |
|---|---|---|---|---|
| | | DW14A | DW14B | DW14C |
| Electrical conductor | | Twisted 37 copper wire strands each having a diameter of 0.25 mm | | |
| Section of electric conductor ($mm^2$) | | 1.8 | | |
| First layer | 1 mica tape thickness 0.1 mm heat treatment at more than 400° C. | Kr = 49% | Kr = 35% | Kr = 49% |
| | 1 mica tape thickness 0.1 mm heat treatment at more than 400° C. | — | Kr = 30% | — |
| | 1 mica tape thickness 0.1 mm heat treatment at more than 340° C. | — | — | — |
| Second layer | 1 polyimide tape thickness 0.030 mm | Kr = 30% | | |
| Third layer | 1 PTFE tape | 1 non-UV PTFE tape thickness 0.100 mm Kr = 53% | 1 non-UV PTFE tape thickness 0.100 mm Kr = 53% | 1 non-UV PTFE tape thickness 0.100 mm Kr = 53% |
| | 1 PTFE tape | 1 UV PTFE tape thickness 0.076 mm Kr = 53% | 1 non-UV PTFE tape thickness 0.100 mm Kr = 53% | 1 non-UV PTFE tape thickness 0.100 mm Kr = 53% |
| | 1 PTFE tape | — | 1 UV PTFE tape thickness 0.076 mm Kr = 53% | 1 UV PTFE tape thickness 0.076 mm Kr = 53% |
| Weight of electric cable (g/m) | | 23.4 | 28.3 | 26 |
| Diameter of electric cable (mm) | | 2.72 to 2.80 | 3.3 to 3.43 | 3.10 to 3.18 |

Tables 2a and 2b below show the ratio R of weight per unit length of PTFE over the sum of the weights per unit length of silicone resin and of polyimide, and also the ability of the various electric cables of Tables 1a and 1b to withstand electric arc propagation.

TABLE 2a

| | Electric cable | | | | |
|---|---|---|---|---|---|
| | DW24A | DW20A | DW20B | DW20C | DW20D |
| Collateral damage | 13% | 44% | 20% | 16% | 4% |
| Resistance to electric arc propagation | 87% | 56% | 80% | 84% | 96% |
| Ratio R | 3.44 | 8.1 | 8.1 | 11.9 | 14.9 |

TABLE 2b

| | Electric cable | | |
|---|---|---|---|
| | DW14A | DW14B | DW14C |
| Collateral damage | 67% | 20% | 12% |
| Resistance to electric arc propagation | 33% | 80% | 88% |
| Ratio R | 9.1 | 13 | 15.5 |

The ratio R of the weight per unit length of PTFE over the sum of the weights per unit length of the polymer binder and of the polyimide is calculated from the respective initial weights:

of PTFE coming from the PTFE tape(s) (third layer);

of the polymer binder covering the mica tape(s) (first layer); and of the polyimide coming from the polyimide tape(s) (second layer).

The thicknesses, the compositions, and the structures of the tapes and the overlap coefficients Kr are naturally taken into account when calculating the ratio R.

More particularly, the weight of each of the layers of PTFE (PTFE tape(s)), of the polymer binder (mica tape(s)), and of polyimide (polyimide tape(s)) is obtained by calculating the area occupied by each of the layers and by multiplying by the respective relative density of each layer.

The following equations therefore apply:

Weight of PTFE:

Weight of PTFE=(area(s) occupied by the non-sintered PTFE tape(s))×(relative density=1.62)

The weight of PTFE is calculated prior to the "sintering" baking operation that leads to a contraction of 25% in the radial thickness of the non-sintered PTFE.

Weight of Polymer Binder:

Weight of the mica tape(s)=(area(s) occupied by the mica tape(s))×(relative density=1.30)

The weight of polymer binder is deduced from the weight of the mica tape(s) by multiplying it by the polymer binder content of the mica tape, which content is specified by the supplier.

Weight of polymer binder=(weight(s) of the mica tape(s))×(polymer binder content (%) of the mica tape(s))

Weight of Polyimide:

The weight of polyimide is calculated by multiplying the weight of the polyimide tape that has on each of its faces a layer of fluorinated adhesive (FEP), and by multiplying said weight by the polyimide content of said tape.

Polyimide weight=(area occupied by the polyimide tape) (relative density=1.50)×(polyimide content (%) of the polyimide tape with fluorinated adhesive=76.5%)

Finally, the area occupied by a layer is calculated by subtracting from the area of a circle of diameter equal to the outside diameter (De) of said layer the area of a circle of diameter equal to the inside diameter (Di) of said layer using the following formula:

$$\text{area occupied by a layer} = \frac{\pi}{4} \times (De^2 - Di^2)$$

For the first layer of insulation, the inside diameter is equal to the diameter of the conductor.

The outside diameter of the layer is equal to the sum of the inside diameter plus twice the radial thickness (ER) of the layer, i.e.:

$$De = Di + 2 \times ER$$

The radial thickness (ER) of a tape layer is given by the following equation:

$$ER = \frac{\text{thickness of tape in mm}}{1 - (\text{overlap Kr of tape in \%})}$$

By way of example, the ratio for the DW20D electric cable is calculated as described below, with the method of calculation being identical for the other DW types of electric cable specified in Tables 1a and 1b.

Various standards, well known to the person skilled in the art, relate to said DW electric cables and they specify the diameter of the electrical conductor as a function of its section, the number of conductor wire strands and the diameter of each of said strands, and also the degree to which said conductor strands are compacted.

By way of example, according to the standard EN 2346-005, the diameter of the electrical conductor of the electric cables referenced in Tables 1a and 1b is as specified in Table 3 below.

TABLE 3

| Electric cable | Section of electrical conductor ($mm^2$) | Number of conductor wire strands | Diameter of each conductor wire stand (mm) | Maximum diameter of the electrical conductor (mm) |
|---|---|---|---|---|
| DW24 | 0.25 | 19 | 0.12 | 0.61 |
| DW20 | 0.60 | 19 | 0.20 | 1.04 |
| DW14 | 2.0 | 37 | 0.25 | 1.82 |

Another example of said diameter, in accordance with standard NF EN 4434 is specified in Table 4 below.

TABLE 4

| Electric cable | Section of electrical conductor ($mm^2$) | Number of conductor wire strands | Diameter of each conductor wire stand (mm) | Minimum diameter of the electrical conductor (mm) | Maximum diameter of the electrical conductor (mm) |
|---|---|---|---|---|---|
| DW24 | 0.25 | 19 | 0.12 | 0.555 | 0.585 |
| DW20 | 0.60 | 19 | 0.20 | 0.94 | 0.97 |
| DW14 | 2.0 | 37 | 0.25 | 1.69 | 1.73 |

The diameters of the conductors DW24, DW20, and DW14 in Tables 1a and 1b are those specified respectively in the column "Maximum diameter of the electrical conductor" in Table 4 in accordance with standard EN 4434, said diameters being given by way of non-limiting illustration.

| Conductor diameter = | 0.97 mm |
|---|---|

| First layer: | |
|---|---|
| Mica tape thickness = | 0.100 mm |
| Mica tape overlap Kr = | 37% |
| Mica tape relative density = | 1.30 |
| Mica tape polymer binder content = | 13% |
| Mica layer inside diameter = | 0.97 mm |
| Area of circle having diameter 0.97 mm = | 0.7390 $mm^2$ |
| Radial thickness of mica tape = | 0.1587 mm = 0.100/(1 − 0.37) |
| Outside diameter of mica layer = | 1.2875 mm = 0.97 + 2 × 0.1587 |
| Area circle having diameter 1.2875 mm = | 1.3018 $mm^2$ |
| Area of mica tape layer = | 0.5629 $mm^2$ = 1.3018 − 0.7390 |
| Weight of mica tape layer = | 0.731 = 0.5629 × 1.30 |
| Weight of polymer binder in mica tape = | 0.0951 = 0.7319 × 0.13 |

| Second layer: | |
|---|---|
| Thickness of polyimide tape with fluorinated adhesive = | 0.030 mm |
| Overlap Kr of polyimide tape with fluorinated adhesive = | 30% |
| Relative density of polyimide tape with fluorinated adhesive = | 1.53 |
| Polyimide content of polyimide tape with fluorinated adhesive = | 76.5% |
| Inside diameter of the layer of polyimide with fluorinated adhesive = | 1.2875 mm |
| Area of circle of diameter 1.2875 mm = | 1.3018 $mm^2$ |
| Radial thickness of the polyimide tape with fluorinated adhesive = | 0.0435 mm = 0.03048/(1 − 0.30) |
| Outside diameter of the layer of polyimide with fluorinated adhesive = | 1.3745 mm = 1.2875 + 2 × 0.0435 |
| Area of the layer of tape of polyimide with fluorinated adhesive = | 0.1821 $mm^2$ = 1.4839 − 1.3018 |
| Weight of the layer of tape of polyimide with fluorinated adhesive = | 0.2786 = 0.1821 × 1.53 |
| Weight of the polyimide in the tape of polyimide with fluorinated adhesive = | 0.2131 = 0.2786 × 0.765 |

| Third layer: | |
|---|---|
| Thickness of the first non-sintered PTFE tape = | 0.076 mm |
| Overlap Kr of the first non-sintered PTFE tape = | 53% |
| Relative density of the first non-sintered PTFE tape = | 1.62 |
| Inside diameter of the layer of the first non-sintered PTFE tape = | 1.3745 mm |
| Area of a circle of diameter 1.5362 mm = | 1.4839 $mm^2$ |
| Radial thickness of the first non-sintered PTFE tape = | 0.1617 mm = 0.076/(1 − 0.53) |
| Outside diameter of the layer of the first non-sintered PTFE tape = | 1.6980 mm = 1.3745 + 2 × 0.1617 |
| Area of a circle of diameter 1.6980 mm = | 2.2643 $mm^2$ |
| Area of the layer of the first non-sintered PTFE tape = | 0.7804 $mm^2$ = 1.8536 − 1.4839 |
| Weight of the layer of the first non-sintered PTFE tape = | 1.2643 = 0.7804 × 1.62 |
| Thickness of the second non-sintered PTFE tape = | 0.076 mm |
| Overlap Kr of the second non-sintered PTFE tape = | 53% |
| Relative density of the second non-sintered PTFE tape = | 1.62 |
| Inside diameter of the layer of the second non-sintered PTFE tape = | 1.6980 mm |
| Area of a circle of diameter 1.6980 mm = | 2.2643 $mm^2$ |
| Radial thickness of the second non-sintered PTFE tape = | 0.1617 mm = 0.076/(1 − 0.53) |
| Outside diameter of the layer of the second non-sintered PTFE tape = | 2.0214 mm = 1.6980 + 2 × 0.1617 |
| Area of a circle of diameter 2.0214 mm = | 3.2090 $mm^2$ |
| Area of the layer of the second non-sintered PTFE tape = | 0.9447 $mm^2$ = 3.2090 − 2.2643 |
| Weight of the layer of the second non-sintered PTFE tape = | 1.5304 = 0.9447 × 1.62 |
| Thickness of the third non-sintered PTFE tape = | 0.076 mm |
| Overlap Kr of the third non-sintered PTFE tape = | 53% |
| Relative density of the third non-sintered PTFE tape = | 1.62 |
| Inside diameter of the layer of the third non-sintered PTFE tape = | 2.0214 mm |
| Area of the circle of diameter 2.0214 mm = | 3.2090 $mm^2$ |
| Radial Thickness of the third non-sintered PTFE tape = | 0.1617 mm = 0.076/(1 − 0.53) |
| Outside diameter of the layer of the third non-sintered PTFE tape = | 2.3448 mm = 2.0214 + 2 × 0.1617 |
| Area of a circle of diameter 2.3448 mm = | 4.3180 $mm^2$ |
| Area of the layer of the third non-sintered PTFE tape = | 1.1090 $mm^2$ = 4.3180 − 3.2090 |
| Weight of the layer of the third non-sintered PTFE tape = | 1.7966 = 1.1090 × 1.62 |
| Total weight of PTFE = | 1.2643 + 1.5304 + 1.7966 = 4.5913 |

Ratio R for the DW20D Electric Cable:

$$R=4.5913/(0.0951+0.2131)=14.9$$

Each electric cable in Tables 1a and 1b was subjected to testing for dry resistance to electric arc propagation using the test method specified in standard NF EN 3475-604.

That test makes it possible, in controlled manner, to produce the effects of failures that are representative of what can happen in use when a bundle of electric cables is damaged by wear, such that electric arcs are triggered between the electric cables and/or between electric cables and a conductive structure.

The test consists in subjecting 18 bundles of 7 electric cables each (having a length of 0.5 m) in succession to 6 different short-circuit current values, 3 of the 18 bundles being tested at the same value for test reproducibility.

For each bundle of 7 cables, two electric cables are voluntarily damaged and short-circuited, giving a total of 18×5=90 electric cables for which the collateral damage is measured.

To satisfy the requirements of standard EN 2346-005, it is necessary for fewer than 25% (collateral damage) amongst the 90 electric cables to be damaged, or identically for the resistance to arc propagation to be at least 75% (where resistance to electric arc propagation=100 collateral damage).

Collateral damage is the ratio between the number of electric cables damaged by the electric arc and the total number of electric cables subjected to the test and not deliberately damaged.

Thus, of the 90 electric cables, it is necessary for at least 67 cables to withstand electric arc propagation when dry.

For this purpose, the collateral damage of the outer layer of 5 electric cables is initially inspected visually.

Then the 5 collateral cables of the bundle are subjected to a test of their ability to withstanding voltage in water using the method of standard EN 3475-302, this being done over a period of time and using an alternating voltage as defined by standard EN 2346-005.

The results of Tables 2a and 2b show clearly that electric cables of the invention (DW24A, DW20B, DW20C, DW20D, DW14B, DW14C) present resistance to electric arc propagation of at least 75% or indeed at least 90% in compliance with the requirements of standard NF EN 3475-604.

Identical results have also been obtained with an electric cable having identical construction to the cable DW20B, but with an electrical conductor section of 0.34 $mm^2$ (DW22) with a ratio R that is greater than or equal to 4.

It can thus be seen that the higher temperature of the heat treatment applied to the first layer in the electric cables of the present invention enhances obtaining much better resistance to electric arc propagation.

For example, resistance to electric arc propagation of 80% is obtained for DW20B, unlike the electric cable DW20A for which 56% was obtained.

Other tests relating to resistance to fire were also performed in application of the methods of standards NF EN 3475-408 and prEN 3475-417.

It can clearly be seen that electric cables of the present invention present fire resistance that is better than the requirements of standard EN 2346-005, i.e. the resistance of the insulation of the electric cable in flame for 15 minutes (according to NF EN 3475-408) or for 5 minutes (according to prEN 3475-417) must be greater than 10,000 Ω.

For example, the fire resistance test NF EN 3475-408 performed on the DW20D electric cable of Table 1a gave insulation resistance lying in the range 64,000 K to 242,000 Ω.

For example, the fire resistance test PrEN 3475-417 performed on the DW20D electric cable of Table 1a in various harness configurations gave an insulation resistance lying in the range 54,000 K to 2,300,000 Ω.

In parallel, it can be deduced therefrom that the heat treatment applied to the first layer in accordance with the present invention is not harmful in terms of the ability of the cable to withstand fire.

The present invention is not limited to the above-described examples of electric cables and it applies more generally to any electric cable that can be envisaged on the basis of the general indications provided in the description of the invention.

What is claimed is:

1. An electric cable comprising:

an electrical conductor surrounded by a first layer having at least one winding of mica tape, said mica tape being made up of mica particles deposited by means of a polymer binder on a backing;

a second layer having at least one winding of a polyimide tape; and a third layer having at least one winding of a polytetrafluoroethylene tape;

the first layer being subjected to heat treatment at a temperature of at least 400° C.; and the ratio R of the weight per unit length of PTFE over the sum of the weights per unit length of the polymer binder and of the polyimide being such that:

R is greater than or equal to 2 when the section of the electrical conductor is no greater than 0.2 $mm^2$;

R is greater than or equal to 4 when the section of the electrical conductor is strictly greater than 0.2 $mm^2$ and strictly less than 0.6 $mm^2$;

R is greater than or equal to 6 when the section of the electrical conductor is equal to 0.6 $mm^2$; and R is greater than or equal to 12 when the section of the electrical conductor is strictly greater than 0.6 $mm^2$.

2. An electric cable according to claim 1, wherein the first layer is subjected to heat treatment for a duration $\underline{t}$ that is at least 30% longer than the duration $t_0$ needed for degassing the first layer, said duration $\underline{t}$ preferably being at least 1 minute.

3. An electric cable according to claim 2, wherein the first layer is subjected to heat treatment for a duration of at least one minute.

4. An electric cable according to claim 1, wherein the mica tape includes at most 20% by weight of polymer binder.

5. An electric cable according to claim 4, wherein the mica tape includes 13% by weight of polymer binder.

6. An electric cable according to claim 1, wherein said polymer binder is a silicone resin.

7. An electric cable according to claim 1, wherein the percentage overlap of a mica tape onto itself during winding and/or of a polyimide tape onto itself during winding is no greater than 49%.

8. An electric cable according to claim 1, wherein the second layer comprises a single winding of polyimide tape.

9. An electric cable according to claim 1, wherein the third layer comprises at least two windings of PTFE tape.

10. An electric cable according to claim 1, wherein the mica particles are of the phlogopite type.

11. An electric cable according to claim 1, wherein the polyimide tape comprises a layer of polyimide covered on each of its face in a coating of fluorinated ethylene propylene polymer.

12. An electric cable according to claim 11, wherein the second layer is subjected to heat treatment at a temperature higher than the melting temperature of the layers of FEP.

13. An electric cable according to claim 1, wherein the third layer is subjected to heat treatment at a temperature higher than 340° C.

14. An electric cable according to claim 1, wherein the third layer further includes an outer layer that is suitable for being marked.

15. An electric harness including at least one electric cable as defined in claim 1.

16. An electric cable according to claim 1, wherein R is greater than or equal to 2 when the section of the electrical conductor is in the range of 0.1 $mm^2$ to 0.2 $mm^2$.

17. An electric cable according to claim 1, R is greater than or equal to 12 when the section of the electrical conductor is strictly greater than 0.6 $mm^2$, and no more than 3 $mm^2$.

* * * * *